US005168992A

United States Patent [19]

Bowdy

[11] Patent Number: 5,168,992

[45] Date of Patent: Dec. 8, 1992

[54] GOLF CASE WITH CLUB RETAINERS

[76] Inventor: Fredrick E. Bowdy, 1920 N. 198th St., Seattle, Wash. 98133

[21] Appl. No.: 739,957

[22] Filed: Aug. 5, 1991

[51] Int. Cl.[5] ..... A63B 55/00

[52] U.S. Cl. ..... 206/315.6; 206/315.4; 206/315.5; 280/DIG. 6

[58] Field of Search ..... 209/315.3–315.8; 280/DIG. 6

[56] References Cited

U.S. PATENT DOCUMENTS

| | | | |
|---|---|---|---|
| D. 172,785 | 8/1954 | Eging | 206/315.3 |
| 1,570,500 | 1/1926 | Kennedy | 206/315.6 |
| 2,367,234 | 1/1945 | Mitchell | 280/DIG. 6 |
| 2,551,009 | 5/1951 | Kaltenbach | 280/DIG. 6 X |
| 2,551,780 | 5/1951 | Wood | 206/315.6 X |
| 2,590,178 | 3/1952 | Jamison | 280/DIG. 6 X |
| 2,597,386 | 5/1952 | Schmid | 280/DIG. 6 X |
| 2,726,874 | 12/1955 | Sullivan | 280/DIG. 6 X |
| 2,911,228 | 11/1959 | Green | 280/DIG. 6 X |
| 3,738,677 | 6/1973 | Renock | 280/DIG. 6 X |
| 4,767,001 | 8/1988 | Kim | 206/315.3 |
| 4,836,565 | 6/1989 | Catalo | 280/DIG. 6 X |
| 4,858,761 | 8/1989 | Fumia | 206/315.3 |
| 4,905,827 | 3/1990 | Kim | 206/315.3 |
| 4,915,221 | 4/1990 | Spangler | 206/315.6 |

FOREIGN PATENT DOCUMENTS

| | | | |
|---|---|---|---|
| 804722 | 11/1958 | United Kingdom | 280/DIG. 6 |
| 1295246 | 11/1972 | United Kingdom | 206/315.2 |

*Primary Examiner*—Sue A. Weaver

*Attorney, Agent, or Firm*—Christensen, O'Connor, Johnson & Kindness

[57] ABSTRACT

The irons of a set of golf clubs are supported in upright condition with their heads at the bottom received in a pan and their shafts in spaced side-by-side relationship. Doors are openable to expose the club shafts or closable to enclose and restrain the clubs against movement.

15 Claims, 3 Drawing Sheets

GOLF CASE WITH CLUB RETAINERS

BACKGROUND OF THE INVENTION

1. Field of the Invention

The present invention relates to a special receptacle for golf clubs and golf accessories.

2. Prior Art

Known golf bags are open at the top for receiving the shafts of golf clubs with the heads projecting from the bag. One or more side compartments may be provided for accessories.

Variations on the standard golf bag are shown in the following patents:

U.S. Pat. No. 4,767,001, issued Aug. 30, 1988 (Kim);
U.S. Pat. No. 4,858,761, issued Aug. 22, 1989 (Fumia);
U.S. Pat. No. 4,905,827, issued Mar. 6, 1990 (Kim);
U.S. Pat. No. 4,915,221, issued Apr. 10, 1990 (Spangler).

Problems with known golf bags are that the club heads are not always fully protected and it can be inconvenient to remove an individual club from or insert an individual club back into the bag.

SUMMARY OF THE INVENTION

The present invention provides a specialized case for receiving several golf clubs in upright, sideby side orientation with the club heads at the bottom. Preferably the heads are received in a protective pan having a continuous sidewall enclosing the club heads. Doors mounted over the pan are openable in opposite directions to reveal substantially the entire lengths of the side-by-side shafts of the clubs for convenient selection, extraction and insertion of a desired club. The doors are hollow and have compartments for accessories. Despite a large amount of storage space, the case is compact and usable with conventional wheeled carts.

DETAILED DESCRIPTION

Figure 1:
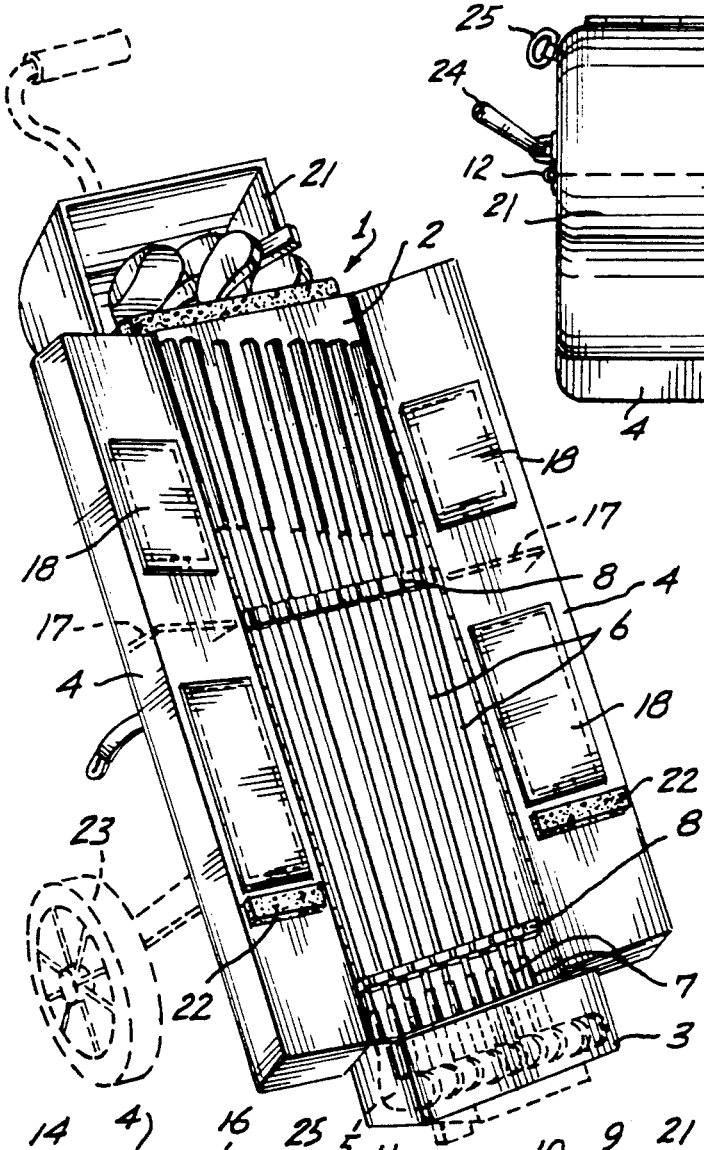
FIG. 1 is a perspective of a golf case in accordance with the present invention including doors and a lid illustrated in their open positions.
Figure 3:
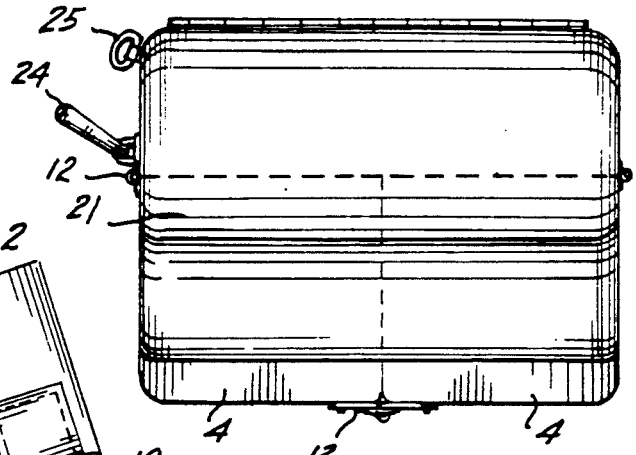
FIG. 3 is a top plan of the case of FIG. 1 with the doors and lid in their closed positions.

With reference to FIG. 1, the golf case 1 in accordance with the present invention includes an upright rigid or substantially rigid body portion 2 having an open-topped pan 3 at the bottom. Oppositely opening doors 4 are hinged to the opposite sides of the body portion 2 above the pan 3. Such doors are movable between the open positions shown in FIGS. 1 and 2 and the closed position shown in FIGS. 3, 4 and 5. At least the irons of a set of golf clubs are stably supported upright with their heads 5 received in and protected by the pan 3 and their shafts 6 in spaced side-by-side relationship for convenient access by the user when the doors are open. With the doors closed, the case firmly holds the clubs in position and allows convenient transport without undue jostling of the clubs.

Figure 2:
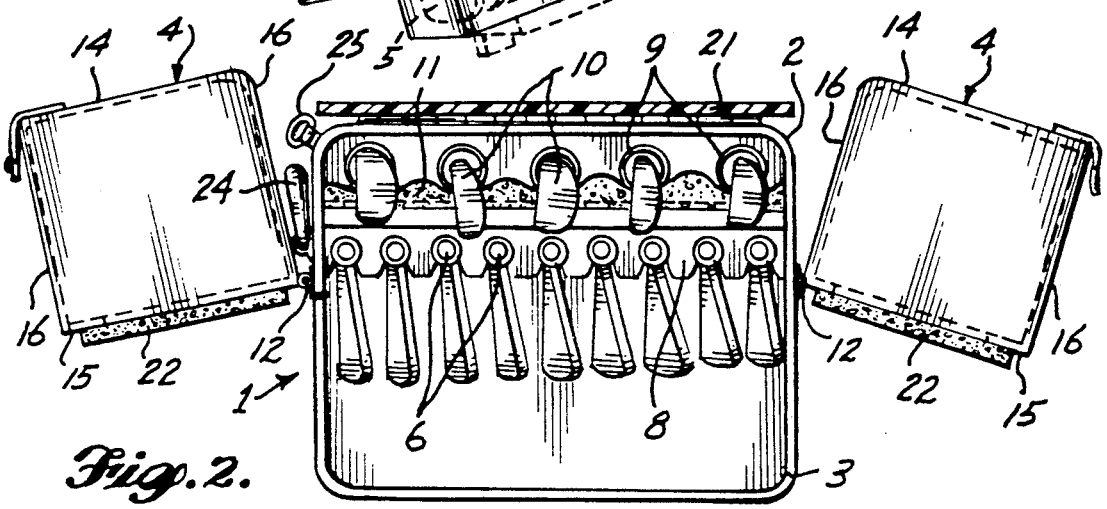
FIG. 2 is a top plan of the case of FIG. 1 with the lid broken away.

The head-enclosing pan 3 extends forward from the bottom portion of the front wall of the case body 2. The continuous upright sidewall of such pan preferably is of a height to enclose the club heads 5 up to about the hosels 7. Each of a pair of notched dividers 8 extends transversely of the case body with notches of the top divider being aligned with the notches of the bottom divider for receiving the club shafts 6 and maintaining in substantially parallel but spaced relationship. As seen in FIG. 2, the rear portion of the case body 2 has upright tubes 9 for the shafts of the woods or other specialized clubs of the set which have their heads 10 projecting upward. Preferably heads 10 are supported on a top resilient cushion or pad 11 which can have depressions for orienting the club heads forward.

Figures 4, 5:
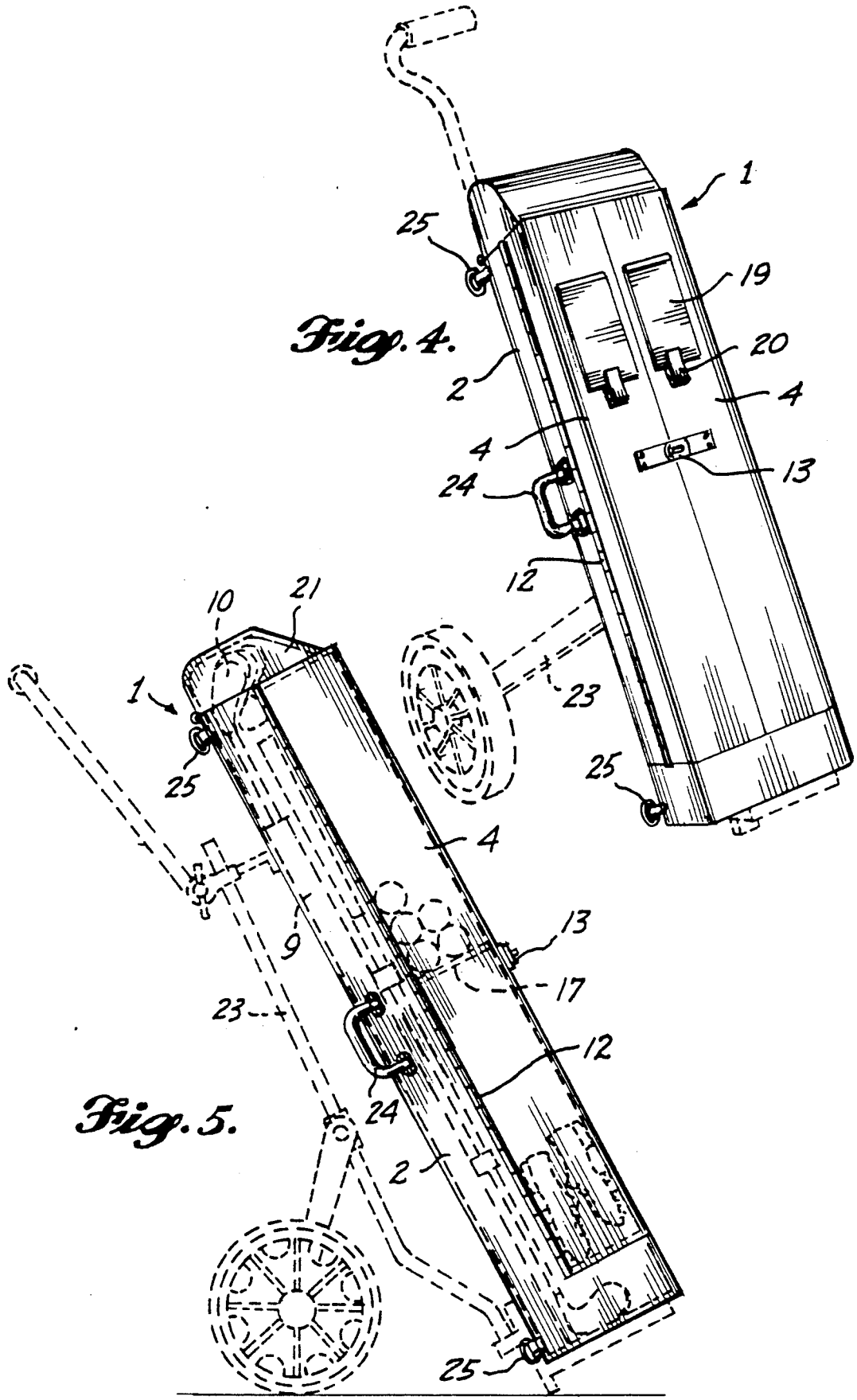
FIG. 4 is a perspective of the case of FIG. 1 with the lid and doors in their closed positions.
FIG. 5 is a right side elevation of the case of FIG. 1 with the doors and lid in their closed positions.

Each door 4 of the case is connected to the front wall of the body 2 by a long hinge 12. The bottom of each door is located immediately above the pan 3. When the doors are closed, as illustrated in FIG. 4, the front surfaces of the doors are flush with the front of the pan. The doors can be retained in their closed positions by a strap and buckle fastener 13 or other suitable locking device.

With reference to FIG. 2, each of the doors 4 is hollow having a front wall 14, back wall 15 and sidewalls 16. Adjacent sidewalls abut when the doors are closed. The interiors of the doors can be used for storage with one or more horizontal partitions dividing the interior of a door into two or more compartments. FIG. 1 illustrates a single partition 17 in each door to form two compartments. Each compartment has an opening in its back wall which can be closed by a flexible flap 18 normally retained in its closed position by hook-and-pile fastenings. With reference to FIG. 4, some of the compartments, such as the top compartments, also can be accessible through the front walls of the doors 4 by rigid closures 19 with manually actuated latch mechanism 20.

A rigid lid 21 preferably is hinged to the back of the case body 2 at the top for enclosing the heads 10 of the clubs received in the tubes 9, as best seen in FIG. 5. Preferably, the interior of the lid has resilient padding for snugly engaging the club heads to act as a restraint when the lid is closed. Suitable latch mechanism can be provided for normally retaining the lid in its closed position.

Similarly, as seen in FIGS. 1 and 2, strips 22 of resilient padding are provided on the back walls of the doors 4 to snugly engage the club shafts 6 when the doors are closed and restrain the clubs from jostling movement.

The composite rectangular case can be conveniently mounted on a conventional wheeled golf cart 23. Otherwise, the case can be carried by means of a swinging handle 24 mounted at one side of the body of the case or by a shoulder strap which can have end clips connectible to top and bottom rings 25 supported from the body. Similar rings can be provided for attachment of other accessories such as a golf towel or umbrella holder.

Figure 6:
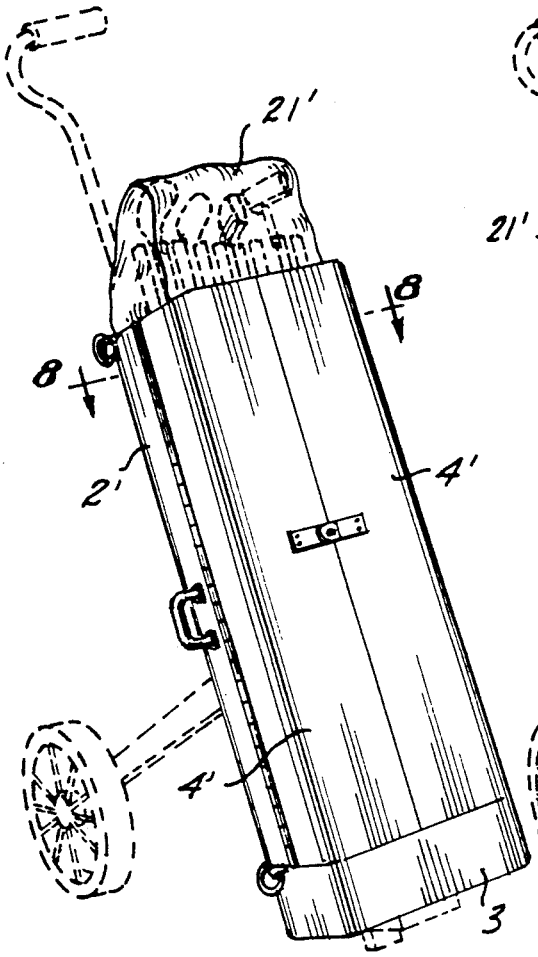
FIG. 6 is a perspective of a modified form of golf case in accordance with the present invention including doors illustrated in their closed positions and a top flexible cover in lieu of a rigid lid.
Figure 7:
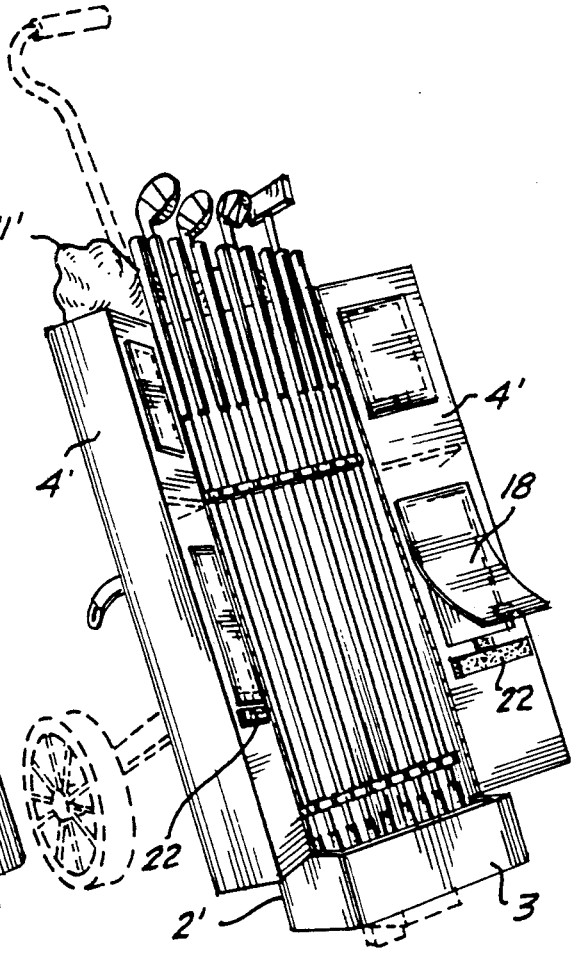
FIG. 7 is a perspective of such modified form but with the doors opened and the cover removed.
Figure 8:
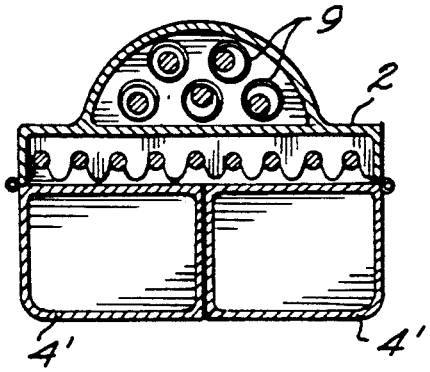
FIG. 8 is a sectional along line 8—8 of FIG. 6.

The modified embodiment illustrated in FIGS. 6, 7 and 8 is substantially the same as the previously described embodiment except that the body 2' and doors 4' are shorter such that the tops of the club shafts 6 extend above the body and doors, and the rigid lid of the previously described embodiment is replaced by a flexible cover 21' which can be secured in position by bottom snaps so as to be manually removable when the case is used on a golf course. Also, in the embodiment of FIGS. 6, 7 and 8 the tubes 9 for the woods or other specialized clubs at the back are bunched together rather than forming a single row. In other respects, the embodiment of FIGS. 6, 7 and 8 is the same as the previously described embodiment including inner restraints 22 on the doors 4' which have closure flaps 18 for access to the door compartments.

In either embodiment, selection, removal and reinsertion of a club is quick and easy because the shafts are stably supported upright in spaced relationship. In addition, the club heads are fully protected in the pan 3 at the bottom. Another advantage is the snug restraint of the clubs when the doors are closed.

I claim:

1. A specialized receptacle for golf clubs comprising a case having a substantially rigid body, said body having means for supporting the clubs in upright condition with their shafts in spaced side-by-side relationship, a pan extending from the bottom portion of said body for supporting the heads of the clubs thereon, and at least one door means moveably mounted on said case body above said pain for opening to reveal the club shafts and for closing to conceal and enclose the shafts, said at least one door means being hollow for forming an interior storage compartment and having opposite upright sides including a first side having an opening therethrough one door means is closed, said first side having an opening therethrough for access to the interior of said at least one door means, the opposite upright sides of the at least one door means including a second side disposed remote from the shafts when said at least one door means is closed, said second side having an opening therethrough for access to the interior of said at least one door means, whereby both of the opposite sides of said at least one door means include access openings.

2. The receptacle defined in claim 1 in which the rigid body has opposite upright sides, and the door means including two doors swingably mounted on such opposite sides respectively, said doors being openable oppositely so as to expose the shafts of the golf clubs and being closable to substantially abutting relationship so as to conceal and enclose the club shafts.

3. The receptacle defined in claim 2, including restraints mounted on the doors for engaging the club shafts when the doors are closed so as to restrain movemen: of the clubs.

4. The receptacle defined in claim 2, in which the supporting means includes at least two elongated dividers spaced apart vertically of the rigid body, said dividers having notches for receiving the club shafts, and the notches of one divider being aligned with the notches of the other divider for supporting the clubs with their shafts extending substantially parallel.

5. The receptacle defined in claim 2, in which the rigid body includes upright tubes at the side of said body opposite the doors for receiving shafts of additional golf clubs with the club heads projecting upward.

6. The receptacle defined in claim 5, including a resilient pad mounted at the upper portion of the rigid body adjacent to the tubes for engagement against the club heads.

7. The receptacle defined in claim 5, including lid means for closing the top of the rigid body above the tubes so as to enclose the upwardly projecting club heads therein.

8. The receptacle defined in claim 7, in which the lid means is movable between an open position in which the upwardly projecting club heads are exposed and a closed position in which the upwardly projecting club heads are enclosed, and including means for restraining the upwardly projecting club heads against movement when the lid means is in its closed position.

9. A specialized receptacle for gold clubs comprising a case having a substantially rigid body, said body having means for supporting the clubs in upright condition with their shafts in spaced side-by-side relationship, a pan extending from the bottom portion of said body for supporting the heads of the clubs thereon, at least one door means moveably mounted on said case body above said pan for opening to reveal the club shafts and for closing to conceal and enclose the shafts, said rigid body including upright tubes at the side of said body opposite said door means for receiving shafts of additional golf clubs with the club heads projecting upward, and a resilient pad mounted at the upper portion of said body adjacent to said tubes for engagement against the upwardly projecting club heads.

10. The receptacle defined in claim 9, including lid means for closing the top of the rigid body above the tubes so as to enclose the upwardly projecting club heads therein.

11. The receptacle defined in claim 10, in which the lid means is movable between an open position in which the upwardly projecting club heads are exposed and a closed position in which the upwardly projecting club heads are enclosed, and including means for restraining the upwardly projecting club heads against movement when the lid means is in its closed position.

12. A specialized receptacle for gold clubs comprising a case having a substantially rigid body, said body having opposite upright sides and means for supporting the clubs in upright condition with their shafts in spaced side-by-side relationship, a pan extending from the bottom portion of said body for supporting the heads of the clubs thereon, door means moveably mounted on said case body above said pan for opening to reveal the club shafts and for closing to conceal and enclose the shafts, said door means including two doors swingably mounted, respectively, on said opposite upright sides of said body, said two doors being openable oppositely so as to expose the shafts of the golf clubs and being closeable to substantially abutting relationships so as to conceal and enclose the club shafts, at least one of said doors being hollow for forming an interior storage compartment and having opposite upright sides including a first side disposed adjacent to the shafts when said at least one door is closed, said first side having an opening therethrough for access to the interior of said at least one door, said rigid body including upright tubes at the side of said body opposite said doors for receiving shafts of additional clubs with the club heads projecting upward.

13. The receptacle defined in claim 12, including a resilient pad mounted at the upper portion of the rigid body adjacent to the tubes for engagement against the club heads.

14. The receptacle defined in claim 13, including lid means for closing the top of the rigid body above the tubes so as to enclose the club heads therein.

15. The receptacle defined in claim 14, in which the lid means is moveable between an open position in which the club heads are exposed and a closed position in which the club heads are enclosed, and including means for restraining the club heads against movement when the lid means is in its closed position.

* * * * *

UNITED STATES PATENT AND TRADEMARK OFFICE

CERTIFICATE OF CORRECTION

PATENT NO. : 5,168,992

DATED : December 8, 1992

INVENTOR(S) : F.E. Bowdy

It is certified that error appears in the above-identified patent and that said Letters Patent is hereby corrected as shown below:

| COLUMN | LINE | |
|---|---|---|
| 1 | 26 | "sideby side" should read --side-by-side-- |
| 3 (Claim 1, Lines 12 & 13) | 31 & 32 | delete "having an opening therethrough" and insert --disposed adjacent to the shafts when said at least--. |

Signed and Sealed this

Twenty-sixth Day of October, 1993

*Attest:*

Bruce Lehman

BRUCE LEHMAN

*Attesting Officer*

*Commissioner of Patents and Trademarks*